US011400716B2

(12) United States Patent
Suzuki

(10) Patent No.: US 11,400,716 B2
(45) Date of Patent: Aug. 2, 2022

(54) LIQUID JET HEAD HAVING HIGH AND LOW RIGIDITY SUPPORT PARTS

(71) Applicant: SII PRINTEK INC., Chiba (JP)

(72) Inventor: Kenji Suzuki, Chiba (JP)

(73) Assignee: SII PRINTEK INC., Chiba (JP)

( * ) Notice: Subject to any disclaimer, the term of this patent is extended or adjusted under 35 U.S.C. 154(b) by 0 days.

(21) Appl. No.: 17/122,201

(22) Filed: Dec. 15, 2020

(65) Prior Publication Data

US 2021/0394512 A1 Dec. 23, 2021

(30) Foreign Application Priority Data

Dec. 19, 2019 (JP) ..... JP2019-229490

(51) Int. Cl.
*B41J 2/14* (2006.01)

(52) U.S. Cl.
CPC ..... *B41J 2/1433* (2013.01)

(58) Field of Classification Search
CPC ..... B41J 2/1433
See application file for complete search history.

(56) References Cited

U.S. PATENT DOCUMENTS 5,670,999 A 9/1997 Takeuchi et al.
2019/0134980 A1* 5/2019 Yamazaki ..... B41J 2/1433

FOREIGN PATENT DOCUMENTS

JP H06-122197 A 5/1994

OTHER PUBLICATIONS

Extended European Search Report in Europe Application No. 20214953.0, dated May 10, 2021, 9 pages.

* cited by examiner

*Primary Examiner* — Bradley W Thies
(74) *Attorney, Agent, or Firm* — Crowell & Moring LLP

(57) ABSTRACT

A stress caused in an actuator member with respect to input or output of heat is reduced. There is provided a liquid jet head including an actuator member having a pressure chamber, a low rigidity support part which is disposed at one side with respect to the actuator member, and is coupled to the actuator member, and a high rigidity support part which is disposed at the other side opposite to the one side with respect to the actuator member, and is coupled to the actuator member. The high rigidity support part has a high rigidity part which includes a head constituent member of the liquid jet head higher in linear expansion coefficient and Young's modulus than the actuator member, and which reduces a thermal deformation of the high rigidity support part in a direction of extension or contraction of the actuator member with respect to input or output of heat to or from the liquid jet head to be smaller than a thermal deformation exhibited in the direction of the extension or the contraction by the head constituent member with respect to the input or the output of the heat. The low rigidity support part is lower in rigidity in the direction of the extension or the contraction than the actuator member.

8 Claims, 8 Drawing Sheets

LIQUID JET HEAD HAVING HIGH AND LOW RIGIDITY SUPPORT PARTS

RELATED APPLICATIONS

This application claims priority to Japanese Patent Application No. 2019-229490 filed Dec. 19, 2019, the entire content of which is incorporated herein by reference.

BACKGROUND OF THE INVENTION

1. Field of the Invention

The present disclosure relates to a liquid jet head and a liquid jet recording device.

2. Description of the Related Art

In an inkjet type liquid jet recording device, by supplying ink from an ink tank to an inkjet head, and jetting the ink from a plurality of nozzle holes provided to the inkjet head toward a recording target medium such as recording paper, recording of images, characters, or the like is performed.

In JP-A-06-122197, there is disclosed a technology of reducing a compression or tensile stress generated in an ink pump made of a ceramic material provided to the inkjet head due to a difference in thermal expansion characteristic from a nozzle member made of metal.

Specifically, in the technology, a thermal expansion characteristic adjustment member provided with an appropriate thermal expansion characteristic in view of the relationship with the ink pump member or the nozzle member is stacked on the ink pump member and the nozzle member to integrally be joined to each other.

In the liquid jet head or the liquid jet recording device, against a background of the tendency of further reduction in size, an increase in definition, and so on of the liquid jet head, it is desired to compensate a decrease in strength of the actuator member through reduction in the stress generated in an actuator member to thereby prevent damage of the actuator member. When there is input or output of heat to or from the liquid jet head, a thermal deformation corresponding to the heat occurs in the actuator member in some cases. Damage due to the thermal deformation of the actuator member is also regarded as an object which is desired to be prevented.

SUMMARY OF THE INVENTION

In one aspect of the present disclosure, there is provided a liquid jet head including an actuator member having a pressure chamber, a low rigidity support part which is disposed at one side with respect to the actuator member, and is coupled to the actuator member, and a high rigidity support part which is disposed at the other side opposite to the one side with respect to the actuator member, and is coupled to the actuator member.

In the liquid jet head according to the present aspect, the high rigidity support part has a high rigidity part which includes a head constituent member of the liquid jet head higher in linear expansion coefficient and Young's modulus than the actuator member, and which reduces a thermal deformation of the high rigidity support part in a direction of extension or contraction of the actuator member with respect to input or output of heat to or from the liquid jet head to be smaller than a thermal deformation exhibited in the direction of the extension or the contraction by the head constituent member with respect to the input or the output of the heat, and the rigidity in the direction of the extension or the contraction of the low rigidity support part is set to be lower than that of the actuator member.

In another aspect, there is provided a liquid jet recording device including the liquid jet head according to the above aspect, the carriage to which the liquid jet head is attached, and a support mechanism configured to be able to support the carriage at a predetermined relative position to a recording target medium.

In the present disclosure, it is possible to prevent the local concentration of the stress caused in the actuator member with respect to input or output of heat to or from the liquid jet head. Therefore, it is possible to prevent damage due to the thermal deformation of the actuator member, which makes a contribution to securement or extension of the product life of the liquid jet head and the liquid jet recording device.

DETAILED DESCRIPTION OF THE PREFERRED EMBODIMENTS

An embodiment of the present disclosure will hereinafter be described in detail with reference to the drawings.

Overall Configuration of Printer 1

Figure 1:
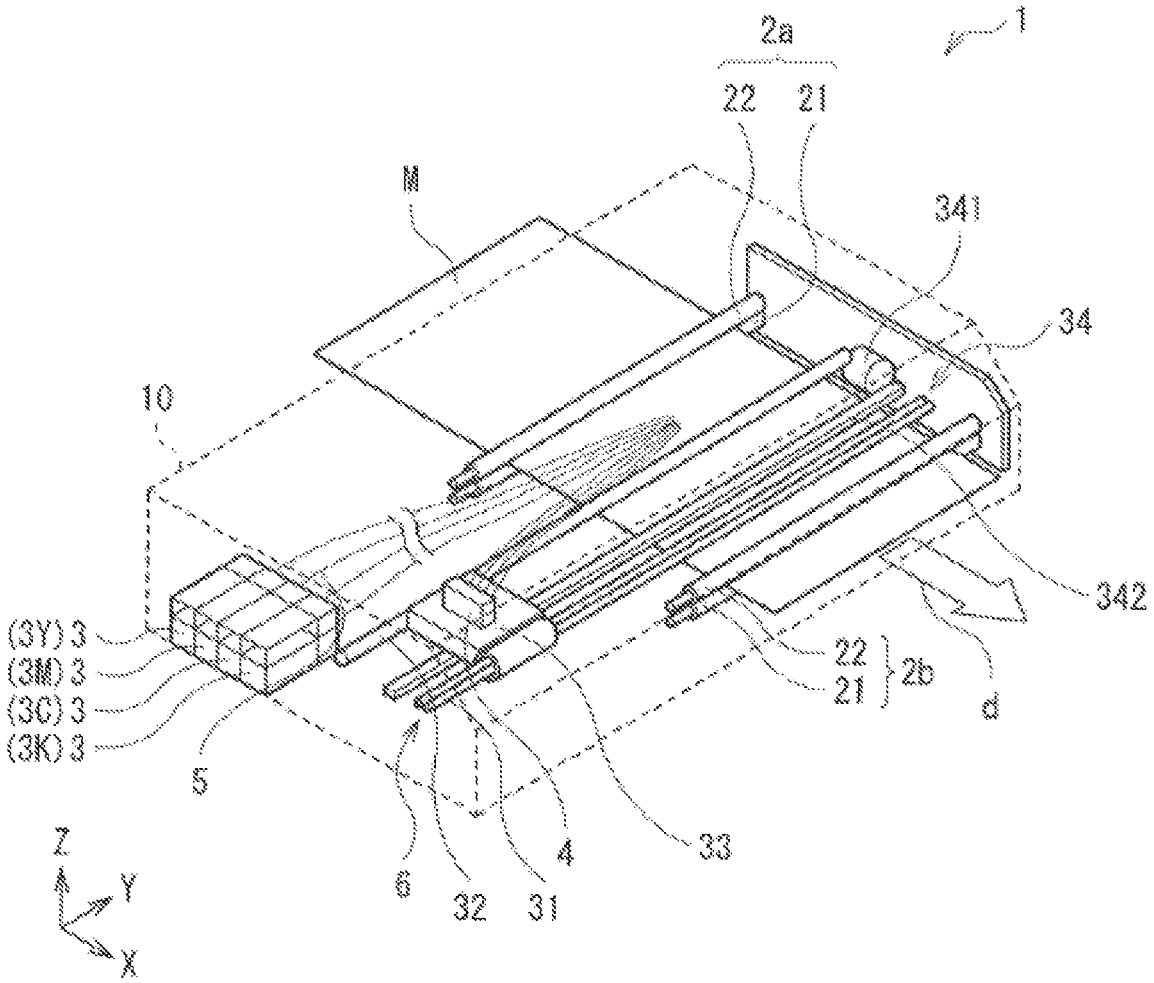
FIG. 1 is a perspective view schematically showing an internal structure of a printer according to an embodiment of the present disclosure.

FIG. 1 schematically shows an internal structure of a printer 1 according to the embodiment of the present disclosure with a perspective view. The printer 1 is an inkjet-type printer for performing recording (printing) of images, characters, or the like with ink on recording paper M as a "recording target medium" related to the present embodiment. Here, the ink corresponds to a "liquid" related to the present embodiment.

The printer 1 is provided with a pair of carrying mechanisms 2*a*, 2*b*, ink tanks 3, inkjet heads 4, supply tubes 5, and a scanning mechanism 6. These components or members are housed in a chassis 10 the outer shape of which is schematically represented by the dotted lines in FIG. 1. Here, in each of the drawings hereinafter referred to, the sizes of the components or the members are arbitrarily changed for the sake of convenience of illustration, and the proportions between the components and so on, or the proportions of the components and so on to the whole of the printer 1 do not accurately represent the actual scale sizes.

The printer 1 corresponds to a "liquid jet recording device" according to the present embodiment, and the inkjet heads 4 each correspond to a "liquid jet head" according to the present embodiment.

Carrying Mechanisms 2*a*, 2*b*

The carrying mechanisms 2*a*, 2*b* carry the recording paper M along a carrying direction d (an X direction in FIG. 1 in the present embodiment). The carrying mechanisms 2*a*, 2*b* are each provided with a grit roller 21 and a pinch roller 22, and at the same time, provided with a drive mechanism not shown. The grit roller 21 and the pinch roller 22 are disposed so that the respective rotational axes thereof are parallel to each other and extend along a Y direction (a direction traversing the recording paper M in the width direction thereof, and a direction perpendicular to the carrying direction d of the recording paper M). The drive mechanism is a mechanism for driving the grit roller 21 to rotate the grit roller 21 around the axis, namely in a Z-X plane, and is provided with, for example, an electric motor as a power source. The pinch roller 22 is pressed against the grit roller 21 in the radial direction to pinch the recording paper M between the pinch roller 22 and the grit roller 21. In the present embodiment, the electric motor and the grit roller 21 are coupled to each other via an arbitrary power transmission medium such as a pulley.

Ink Tanks 3

The ink tanks 3 contain the ink color by color. In the present embodiment, as the ink tanks 3, there are disposed four types of ink tanks 3Y, 3M, 3C, and 3K for individually containing the ink of a plurality of colors such as four colors of yellow (Y), magenta (M), cyan (C), and black (K). These ink tanks 3Y, 3M, 3C, and 3K are arranged side by side in the X direction inside the chassis 10. The ink tanks 3Y, 3M, 3C, and 3K all have the same configuration except the color of the ink contained. Therefore, in the following description, the generic term of ink tank 3 is used without the discrimination based on the colors.

Inkjet Heads 4

The inkjet heads 4 are coupled to the ink tanks 3 via the supply tubes 5, respectively. In the present embodiment, the inkjet heads 4 each have a plurality of jet holes (schematically represented by the reference symbol 45*h* in, for example, FIG. 4), and each jet the ink received from the ink tank 3 via the supply tube 5 toward the recording paper M from the plurality of jet holes 45*h* in the state of a droplet. The ink jetted adheres to the surface of the recording paper M, and thus, the recording of an image, a character, or the like is performed. In the present embodiment, the plurality of inkjet heads 4 is provided, and the plurality of inkjet heads 4 is fixed to a single carriage 33 described later. The inkjet heads 4 are each supplied with the ink of one of the colors of yellow, magenta, cyan, and black. This is not a limitation, but it is possible to adopt a configuration in which two or more colors of ink are supplied to one inkjet head 4.

Scanning Mechanism 6

The scanning mechanism 6 makes the inkjet heads 4 move, namely perform a scanning action, in the width direction of the recording paper M (i.e., the Y direction). The scanning mechanism 6 is provided with a pair of guide rails 31, 32, a carriage 33, and a drive mechanism 34, wherein the pair of guide rails 31, 32 extend in the Y direction, the carriage 33 is supported so as to be able to move on the pair of guide rails 31, 32, and the drive mechanism 34 moves the carriage 33 in the Y direction. The drive mechanism 34 is provided with an electric motor 341 as a power source, and at the same time, provided with an endless belt 342 spanning a pair of pulleys not shown. The carriage 33 is attached to the endless belt 342, and by the power of the electric motor 341 being transmitted to the carriage 33 via the endless belt 342, the carriage 33 moves on the guide rails 31, 32 in the Y direction.

The carriage 33 corresponds to a "carriage" related to the present embodiment, and the scanning mechanism 6 constitutes a "support mechanism" related to the present embodiment.

In the present embodiment, by moving the carriage 33 in the Y direction with the scanning mechanism 6, the carriage 33 and the inkjet heads 4 are made movable (specifically, in the Y direction) relatively to the recording paper M. Such a configuration is called a shuttle type. The "support mechanism" related to the present embodiment is not limited to this configuration, but can also be a configuration in which the carriage and the inkjet heads are fixed to predetermined positions. In other words, the printer according to the present embodiment is not limited to the shuttle type, but can be a printer of a so-called one-pass type or a so-called single-pass type having a configuration in which the positions of the carriage and the inkjet heads are fixed, and only the recording target medium is made movable.

Schematic Configuration of Inkjet Heads 4

Figure 2:
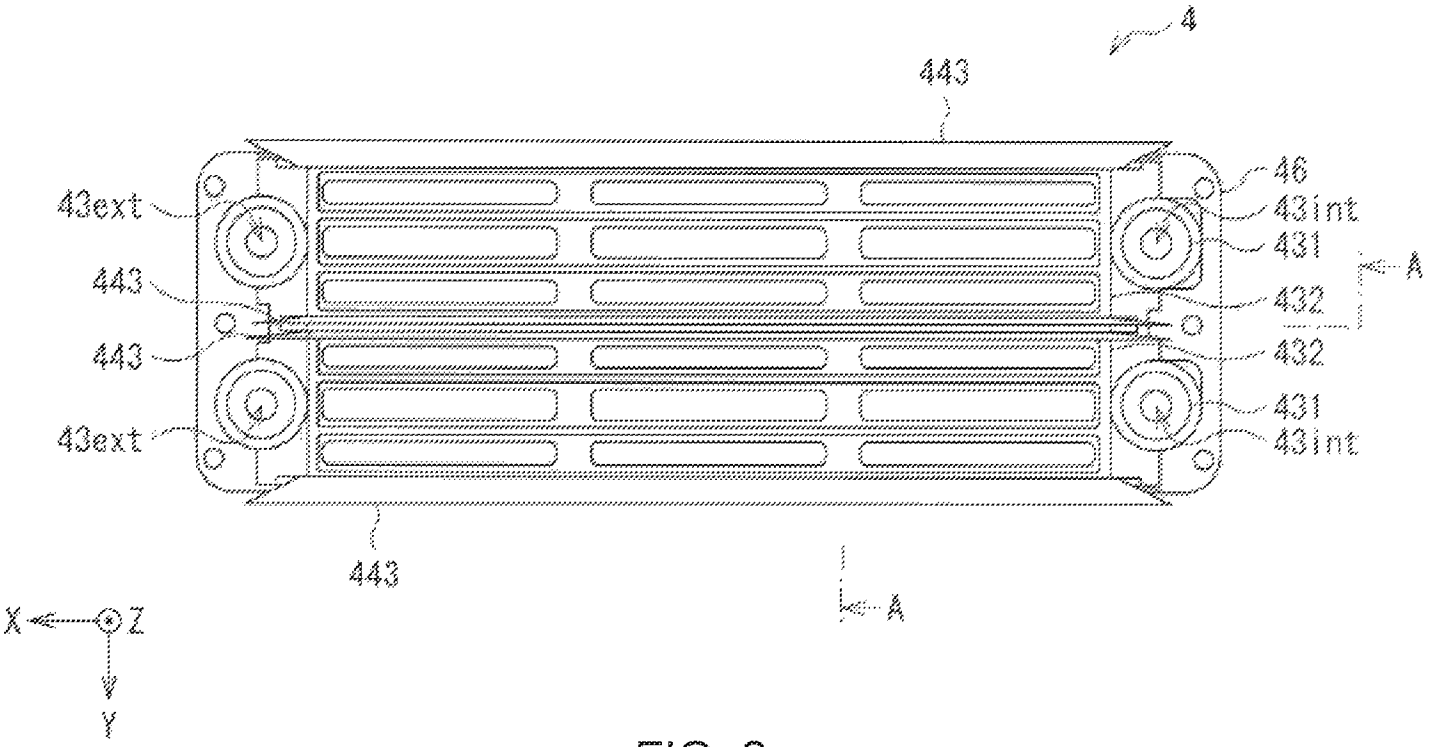
FIG. 2 is a plan view of an inkjet head provided to the printer according to the embodiment, and shows a configuration of the inkjet head in a state with a head cover detached.
Figure 3:
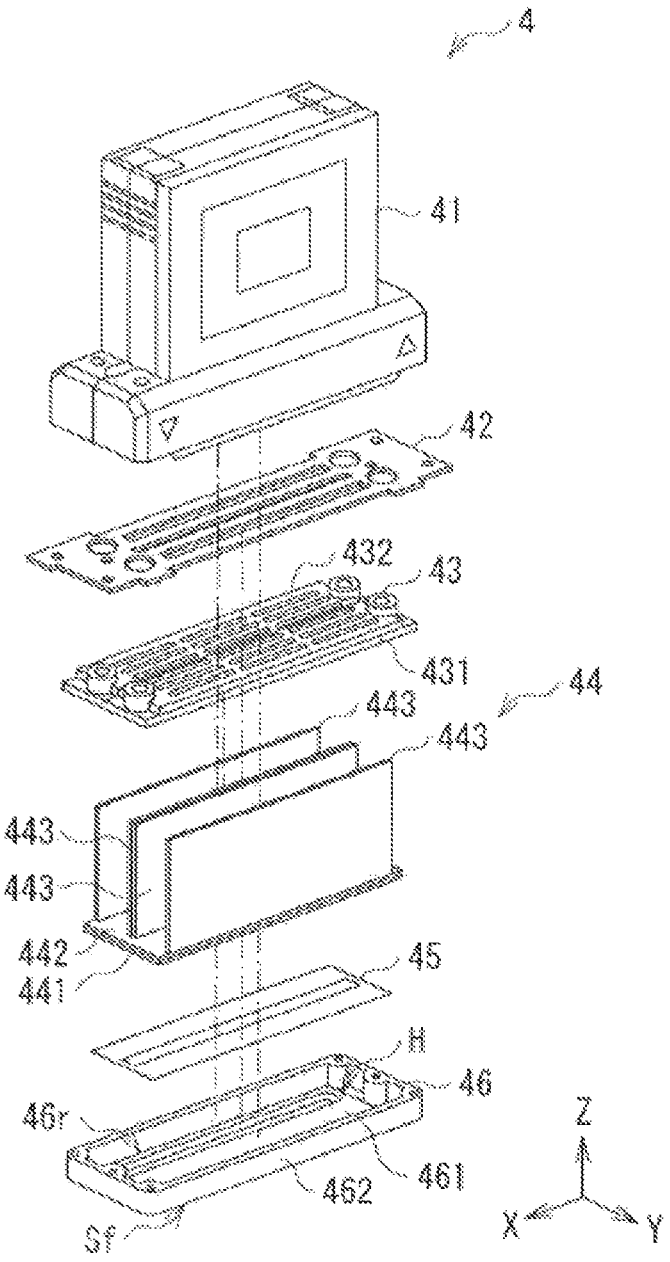
FIG. 3 is an exploded perspective view of the inkjet head (including the head cover) according to the embodiment.

The configuration of the inkjet heads 4 will further be described with reference to FIG. 2 and FIG. 3. FIG. 2 is a plan view of the configuration of the inkjet heads 4 viewed in the ejection direction of the ink via the jet holes 45*h*, and FIG. 3 is an exploded perspective view showing the configuration of the inkjet heads 4. FIG. 2 shows the configuration of the inkjet heads 4 in the state in which a head cover 41 and an upper base plate 42 described later are detached. In FIG. 2 and FIG. 3, it is assumed that an up and down directions or the vertical direction is defined along the Z axis, an upper side is defined in a positive direction along the Z axis, and a lower side is defined in a negative direction. In other words, the ejection direction of the ink in those drawings is a downward direction, in other words, a negative direction along the Z axis.

As shown in FIG. 3, in general, the inkjet heads 4 are each provided with the head cover 41, the upper base plate 42, a flow channel member 43, a head chip 44, a nozzle plate 45, and a lower base plate 46.

Head Chip 44

The head chip 44 is provided with an actuator plate 441, and a cover plate 442 which is disposed at one side with respect to the actuator plate 441, and is joined to the actuator plate 441. In the present embodiment, the actuator plate 441 and the cover plate 442 are joined to each other with an adhesive.

The actuator plate 441 is formed of a piezoelectric substrate made of a ceramic material such as lead zirconate titanate (PZT). The actuator plate 441 has a plurality of grooves (each called a jet channel or an ejection channel) respectively communicated with the jet holes 45*h* of the nozzle plate 45, and electrically change the pressure in each of the jet channels to which the ink is introduced due to the piezoelectric effect of a wall part (hereinafter particularly referred to as a "drive wall" in some cases) of the actuator plate 441 forming the jet channel when performing recording (printing) on the recording paper M. Thus, the ink in the jet channel the pressure in which is changed is pushed out from the jet channel toward the jet hole 45*h*, and is jetted outside via the jet hole 45*h*. In the present embodiment, as grooves in the actuator plate 441, there are formed non-jetting channels or dummy channels not communicated with the jet holes 45*h* besides the jet channels communicated with the respective jet holes 45*h*. The jet channels and the non-jetting channels are alternately disposed in a direction perpendicular to the direction in which the grooves extend, and at the same time, separated from each other with the wall parts of the actuator plates 441.

The actuator plate 441 corresponds to an "actuator member" related to the present embodiment, and the "grooves" (specifically, the grooves functioning as the jet channels) provided to the actuator plate 441 each correspond to a "pressure chamber" related to the present embodiment.

The cover plate 442 is formed of the same material as that of the actuator plate 441, namely the ceramic material such as PZT. The cover plate 442 is for selectively making the ink which intervenes between the actuator plate 441 and the flow channel member 43 and is supplied via the flow channel member 43 inflow into the jet channels out of the jet channels and the non-jetting channels of the actuator plate 441. The material applicable to the cover plate 442 is not limited to the same material as that of the actuator plate 441, but can also be a material different from that of the actuator plate 442. As such a material, there can be illustrated a material (e.g., resin) having impermeability with respect to the ink besides the ceramic material.

The inkjet head 4 is further provided with an electronic control panel not shown, and is configured so that the voltages causing a piezoelectric effect in the drive walls of the actuator plate 441 can be controlled by the electronic control panel. The electronic control panel and the drive wall (specifically, the electrodes formed on the drive walls) of the actuator plate 441 are coupled to each other via a flexible board 44, and it is possible to apply the voltages controlled by the electronic control panel to the electrodes on the drive walls via the flexible board 44.

Nozzle Plate 45

The nozzle plate 45 has a plurality of communication holes functioning as the jet holes 45*h* when ejecting the ink. In the present embodiment, the plurality of communication holes is arranged side by side in a direction in which the ink flows inside the flow channel member 43, in other words a direction (the X direction shown in FIG. 2) from introduction ports 43*int* of the flow channel member 43 toward discharge ports 43*ext*. In the nozzle plate 45, a surface having the jet holes 45*h* is exposed on a surface Sf of the lower base plate 46, namely downward, via an opening of the lower base plate 46 in the state in which the nozzle plate 45 is attached to the lower base plate 46, and it is possible for the nozzle plate 45 to jet the ink downward (in other words, a negative direction along the Z axis), In the present embodiment, the nozzle plate 45 is joined to either of the head chip 44 and the lower base plate 46 with an adhesive.

The nozzle plate 45 corresponds to a "nozzle member" related to the present embodiment.

Flow Channel Member 43

A plurality of flow channels (ink supply channels p1, ink discharge channels p2) is formed inside the flow channel member 43, and the flow channel member 43 introduces the ink in the head chip 44 or the actuator plate 441 (specifically, the grooves as the jet channels) via the plurality of flow channels. The flow channel member 43 is provided with the introduction ports 43*int* and the discharge ports 43*ext*, and receives the ink supplied from the ink tank 3 in the ink supply channel p1 via the introduction ports 43*int*, and at the same time, discharges a part of the ink thus supplied from the ink discharge channels p2 via the discharge ports 43*ext*. In the present embodiment, the flow channel member 43 is joined to the head chip 44 with an adhesive.

The flow channel member 43 corresponds to a "flow channel member" related to the present embodiment, and the flow channels (in particular, the ink supply channels p1) each correspond to a "flow channel of a liquid" related to the present embodiment.

Lower Base Plate 46

The lower base plate 46 is bonded to the head cover 41, and a housing chamber H in which a joined body (hereinafter referred to as a "head chip joined body" in some cases) of the head chip 44, the flow channel member 43, and the nozzle plate 45 is housed is formed between the lower base plate 46 and the head cover 41. In the present embodiment, the lower base plate 46 has a bottom part 461, and a side part 462 surrounding the bottom part 461 throughout the entire circumference, a recessed part 46*r* is formed at the center of the lower base plate 46 with the bottom part 461 and the side part 462, and the head chip joined body is housed in the recessed part 46*r*. In other words, in the present embodiment, the housing chamber H for the head chip joined body is formed of the recessed part 46*r* of the lower base plate 46. The lower base plate 46 has holes (hereinafter referred to as "through holes") or slits penetrating the bottom part 461 in the thickness direction, and the ink jetted from the jet holes 45*h* of the nozzle plate 45 goes outside the inkjet head 4 via the through holes. As described above, the lower base plate 46 is bonded to the nozzle plate 45 or the head chip joined body with the adhesive. When assembling the inkjet head 4, the adhesive for joining the lower base plate 46 is applied so as to surround throughout the entire circumference of each of the through holes for transmitting the ink when jetting the ink.

The lower base plate 46 corresponds to a "base member" related to the present embodiment. Further, the bottom part 461 of the lower base plate is for forming a "support surface" related to the present embodiment, and an inner surface of the bottom part 461 corresponds to the "support surface."

Upper Base Plate 42

The upper base plate 42 intervenes between the lower base plate 46 and the head cover 41, closes an opening of the housing chamber H in which the head chip joined body is housed, and at the same time, seals the head chip joined body in the housing chamber H. The both end parts of the upper base plate 42 extend outside the side surfaces of the short side of the head cover 41 and the lower base plate 46. The inkjet head 4 is supported with respect to the carriage 33 via the upper base plate 42 by fixing the both end parts of the upper base plate 42 extending from the head cover 41 and the lower base plate 46 to the carriage 33.

Head Cover 41

The head cover 41 is coupled to the lower base plate 46 in the state of housing the electronic control panel described above.

Detailed Configuration of Inkjet Heads 4

Figure 4:
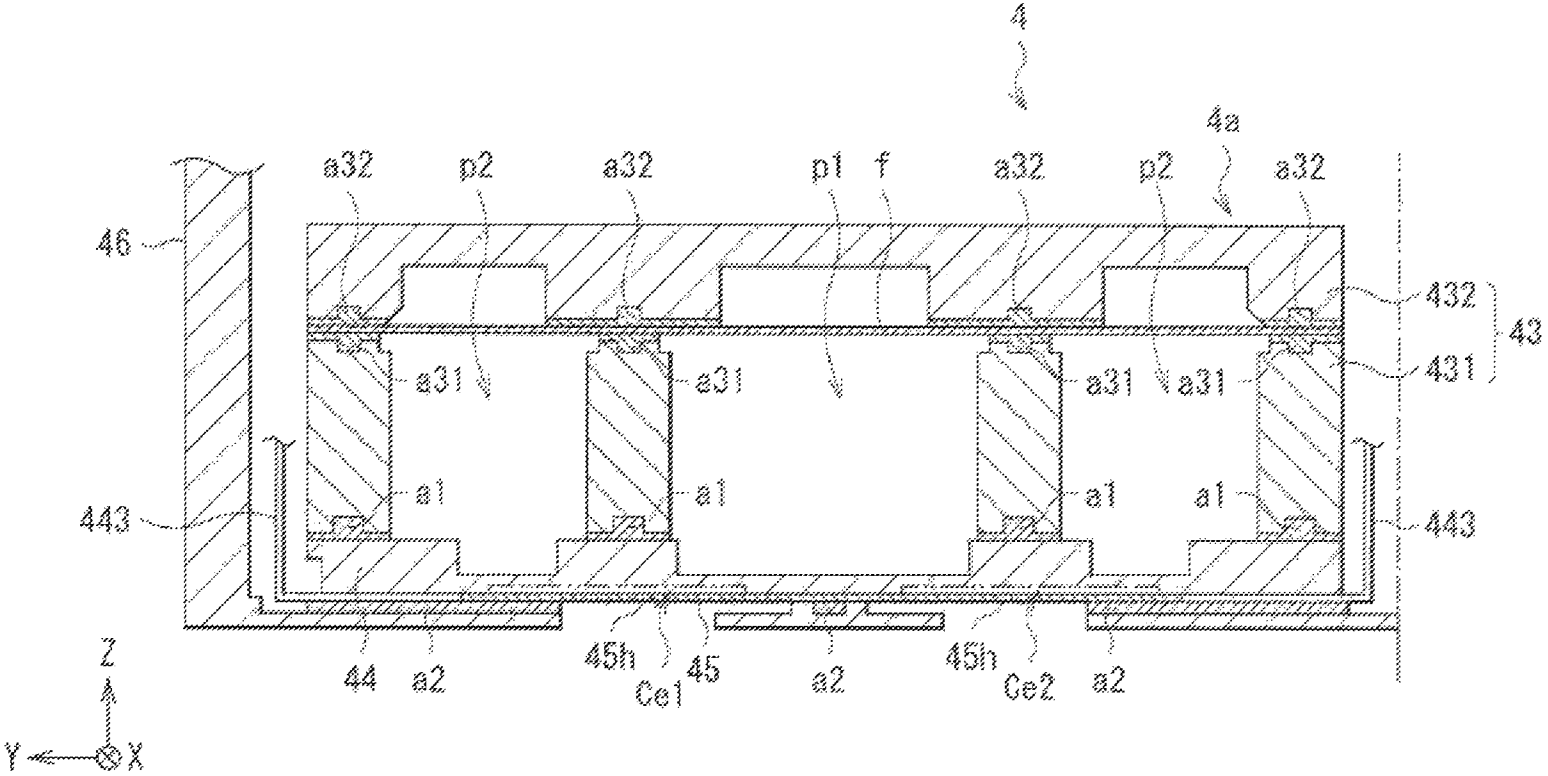
FIG. 4 is a cross-sectional view along the line A-A shown in FIG. 2, and shows a specific configuration of the inkjet head.

FIG. 4 is a cross-sectional view along the line A-A shown in FIG. 2, and shows a specific configuration of the inkjet head 4. In the present embodiment, the channels for circulating the ink inside one inkjet head 4 are configured so as to be divided into two systems different in the introduction port 43*int* and the discharge port 43*ext* as shown in FIG. 2, but FIG. 4 shows the configuration of one of these systems alone for the sake of convenience of illustration. The configuration of the other system not shown is substantially the same as the configuration shown in the drawing except the point that the configuration is in the line symmetrical relationship based on the center line represented by the dashed-dotted line in the drawing.

Figure 6A:
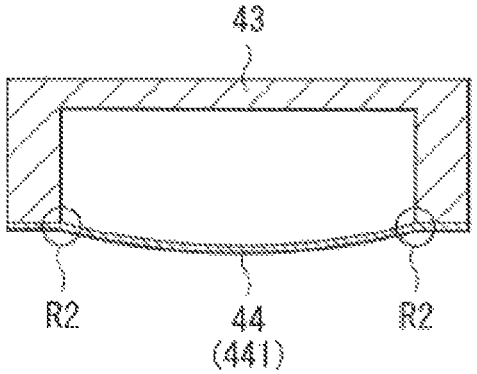
FIGS. 6A and 6B are schematic diagrams for explaining another example of an advantage obtained by the embodiment.
Figure 6B:
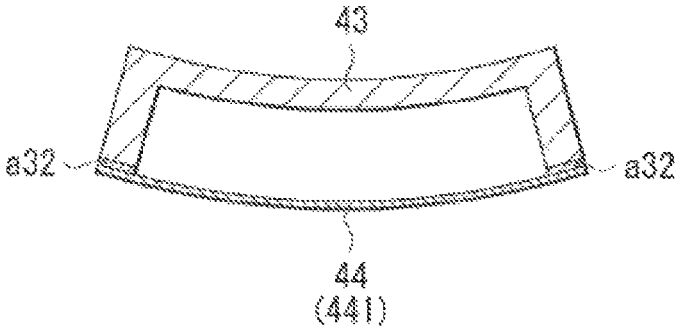

As described above, the inkjet head 4 is provided with the flow channel member 43, the head chip 44 (the actuator plate 441 and the cover plate 442), the nozzle plate 45, and the lower base plate 46 in this order from a far side from the jet holes 45*h* of the ink. The flow channel member 43 and the head chip 44 (specifically, the cover plate 442), and the head chip 44 (specifically, the actuator plate 441) and the nozzle plate 45 are each joined to each other with an adhesive to form an integrated joined body (the head chip joined body) 4*a*. Further, the head chip joined body 4*a* formed in such a manner is joined to the lower base plate 46 with an adhesive. In FIGS. 6A and 6B, the adhesive for joining the head chip 44 and the flow channel member 43 to each other is denoted by the reference symbol a1, and the adhesive for joining the head chip 44 and the lower base plate 46 to each other, namely the adhesive for joining the head chip joined body 4*a* and the lower base plate 46 to each other, is denoted by the reference symbol a2.

The adhesive a2 corresponds to a "first adhesive" related to the present embodiment.

The actuator plate 441 of the head chip 44 has a pressure chamber for applying pressure to the ink when jetting the ink. In the actuator plate 441, a surface facing to the nozzle plate 45 is provided with the plurality of jet channels Ce (Ce1, Ce2) extending in the Y direction in FIG. 4 (schematically represented by dashed-two dotted lines in the drawing), and each of the jet channels Ce1, Ce2 functions as the pressure chamber. In the present embodiment, the jet channels Ce1, Ce2 are disposed so as to be divided into two rows in the Y direction, and in each of the rows, the plurality of jet channels Ce (e.g., the jet channels Ce1 arranged side by side in the left row viewed when facing to the sheet of FIGS. 6A and 6B) is disposed so as to be arranged side by side in the X direction, and at the same time, the jet channels Ce1, Ce2 in each of the rows each extend in the Y direction.

The flow channel member 43 has the ink supply channels p1 and the ink discharge channels p2 extending the direction in which the jet channels Ce1, Ce2 in each of the rows are arranged side by side, namely the X direction shown in FIG. 4, In the present embodiment, the ink supply channels p1 and the ink discharge channels p2 are all provided in the form of a slit to the flow channel member 43, and the direction in which the ink supply channels p1 extend and the direction in which the ink discharge channels p2 extend are parallel to each other. In the Y direction in FIG. 4 in which the jet channels Ce1, Ce2 extend, the slit located at the center forms the ink supply channel p1, and the slits located at both sides form the ink discharge channels p2. The ink supply channels p1 are each communicated with the introduction port 43*int* to supply the ink to the jet channels Ce1, Ce2 in each of the rows, and the ink discharge channels p2 are each communicated with the discharge port 43*ext* to collect the ink having come out from the jet channels Ce1, Ce2 for each of the rows and then lead out the ink to the discharge port 43*ext*.

Further, in the present embodiment, the flow channel member 43 is divided into a main body 431 forming the ink supply channels p1 and the ink discharge channels p2 as the flow channels of the ink, and a lid part 432 for closing the ink supply channels p1 and the ink discharge channels p2, and the main body 431 and the lid part 432 are joined to each other via a film (hereinafter referred to as a "sealing film") f having impermeability with respect to the ink. Junction between the main body 431 and the sealing film f, and junction between the lid part 432 and the sealing film f are each achieved by an adhesive. In FIG. 4, the adhesive for joining the main body 431 and the sealing film f to each other is denoted by the reference symbol a31, and the adhesive for joining the lid part 432 and the sealing film f to each other is denoted by the reference symbol a32.

The adhesive a31 corresponds to a "third adhesive" related to the present embodiment, and the adhesive a32 corresponds to a "second adhesive."

The nozzle plate 45 has a plurality of communication holes penetrating the nozzle plate 45 in the thickness direction thereof (the Z direction shown in FIG. 4). The communication holes are respectively communicated with the jet channels Ce1, Ce2 of the actuator plate 441, and each function as the jet hole 45*h* of the ink. In the present embodiment, in one nozzle plate 45, totally two rows of jet holes 45*h* are disposed so as to correspond to the respective rows in which the jet channels Ce1, Ce2 are arranged side by side.

Here, the elements (i.e., the flow channel member 43, the head chip 44, and the lower base plate 16) constituting the inkjet head 4 are made of respective materials different from each other, and the inkjet head 4 is formed by joining these constituents made of the respective material different from each other mainly with the adhesives (the adhesives a1, a2, and a3). Further, due to the fact that these constituents are different in linear expansion coefficient and Young's modulus from each other derived from the difference in material, when input or output of the heat to or from the inkjet head 4 occurs, the constituents show respective thermal deformations different from each other as a result. As a cause that the input or output of the heat to or from the inkjet head 4 occurs, there can be cited a change in environment, specifically a change in temperature and so on, in the installation place of the printer 1, or during the transportation of the printer 1.

As a result that the constituents of the inkjet head 4 exhibit the respective thermal deformations different from each other, concentration of stress occurs in the actuator plate 441 (the head chip 44 in the present embodiment since the actuator plate 411 and the cover plate 442 are made of the same material as each other) in some cases. The ceramic material such as PZT constituting the actuator plate 441 related to the present embodiment has a property weak in particular with respect to the stress due to a tensile deformation. Therefore, in the actuator plate 441, it is desirable to prevent an excessively high stress in particular in the tensile direction from occurring.

As a material applicable to the constituents of the inkjet head 4 according to the present embodiment, there will be cited the following example. The material applicable to the flow channel member 43 is not limited to the following, but any resin materials can also be applied as long as the resin materials are resistant to the ink.

The lower base plate 46: stainless steel

The nozzle plate 45: stainless steel

The head chip 44 (the actuator plate 441, the cover plate 442): PZT (lead zirconate titanate)

The flow channel member 43 (the main body 431, the lid part 432): PPS (polyphenylene sulfide resin)

Figure 5A:
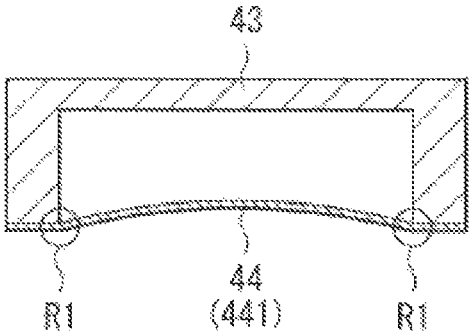
FIGS. 5A and 5B are schematic diagrams for explaining an example of an advantage obtained by an embodiment of the present disclosure.

FIGS. 5A, 5B and FIGS. 6A, 6B show some examples of the thermal deformation exhibited by the actuator plate 441 (the head chip 44 in the present embodiment) when the input or output of the heat to or from the inkjet head 4 occurs. FIG. 5A corresponds to when the actuator plate 441 exhibits the thermal deformation of becoming inward concave with respect to the flow channel member 43, and FIG. 6A corresponds to when the actuator plate 441 exhibits the thermal deformation of becoming outward convex with respect to the flow channel member 43.

As an example of when the thermal deformations shown in FIG. 5A and FIG. 6A occur, there can be cited when the temperature rises in the environment in which the printer 1 is installed. Further, in the example shown in FIG. 5A, such a thermal deformation tends to be facilitated by the fact that the nozzle plate 45 to be joined to the actuator plate 441 is higher in linear expansion coefficient than the actuator plate 441. On the other hand, in the example shown in FIG. 6A, the thermal deformation tends to be facilitated by the fact that the nozzle plate 45 is lower in linear expansion coefficient than the actuator plate 441. The thermal deformation of the actuator plate 441 not only occurs when the heat is input (i.e., when being heated), but also occurs when the heat is output (i.e., when being cooled) in some cases.

Here, as shown in FIG. 5A and FIG. 6A, when the expansion due to the thermal deformation of the actuator plate 441 is in a situation of being partially suppressed by the flow channel member 43, the concentration of the stress, namely the tensile stress, occurs in the actuator plate 441. Specifically, the concentration occurs in the junctions (in particular, in the corner parts thereof) R1, R2 with the flow channel member 43 in the actuator plate 441. In the example (the junctions R1) shown in FIG. 5A, the concentration of the tensile stress occurs at the nozzle plate 45 side, and in the example (the junctions R2) shown in FIG. 6A, the concentration of the tensile stress occurs at the flow channel member 43 side.

In addition, in the present embodiment, since the actuator plate 441 (PZT) is joined to the lower base plate 46 (stainless steel) higher in both of linear expansion coefficient and Young's modulus, a larger thermal deformation than that in the actuator plate 441 occurs in the lower base plate 46 due to the input or output of the heat to or from the inkjet head 4. In this case, the actuator plate 441 is forcibly stretched or compressed by the lower base plate 46. This can be the cause that the excessively high stress occurs in the actuator plate 441.

In contrast, in the present embodiment, by encouraging a natural thermal deformation of the actuator plate 441, it is avoided that a forced deformation occurs in the actuator plate 441 to suppress the concentration of the stress, and thus, the excessively high stress is prevented from being applied.

Specifically, the inkjet head 4 is sectioned into a low rigidity support part at one side of the actuator plate 441, and a high rigidity support part at the other side thereof, and these support parts are bonded to the actuator plate 441. In the present embodiment, with respect to the actuator plate 441, the high rigidity support part is formed at the same side as the side at which the lower base plate 46 is disposed, and the low rigidity support part is formed at an opposite side thereto.

The high rigidity support part is characterized as a structure including a constituent member (i.e., a head constituent member) of the inkjet head 4 higher in linear expansion coefficient and Young's modulus than the actuator plate 441, and in the present embodiment, the high rigidity support part includes the lower base plate 46 as the head constituent member. Further, the high rigidity support part is provided with a high rigidity part, and reduces the thermal deformation of the high rigidity support part in the direction of the extension or the contraction of the actuator plate 441 with respect to the input or output of the heat to or from the inkjet head 4 to be smaller than the thermal deformation exhibited in the direction of the extension or the contraction of the actuator plate 441 by the lower base plate 46 by itself with respect to the same input or output of the heat using the high rigidity part.

In the present embodiment, the high rigidity part is formed of the adhesive a2 for joining the head chip joined body 4*a* to the lower base plate 46. The adhesive a2 is an adhesive (hereinafter referred to as a "hard adhesive" in some cases) having a property that the hardness is relatively high after curing, and in the present embodiment, the adhesive a2 is higher in hardness after curing than the adhesive (hereinafter referred to as a "soft adhesive" in some cases) a32 for joining the lid part 432 of the flow channel member 43 to the sealing film f. Thus, the thermal deformation of the lower base plate 46 itself with respect to the input or output of the heat to or from the inkjet head 4 is suppressed. Although the high rigidity part is formed of the hard adhesive a2 in the present embodiment, this is not a limitation, and it is possible to add a member having the rigidity or the Young's modulus so high as to be able to suppress the thermal deformation of the lower base plate 46 itself, and stack the member on the lower base plate 46 to be joined to each other. It is preferable for the additional member to be lower in linear expansion coefficient than the lower base plate 46.

Here, the hard adhesive a2 is lower in Young's modulus compared to the lower base plate 46 although equivalent in linear expansion coefficient. For example, the linear expansion coefficient of stainless steel as the material of the lower base plate 46 is 1.70E−05 while the linear expansion coefficient of the hard adhesive a2 is 5.00E−05, and the Young's modulus of stainless steel as the material of the lower base plate 46 is 1.90E+05 while the Young's modulus of the hard adhesive a2 is 5.38E+03. However, since the adhesive a2 is applied in a limited range and in a thin layer, the high rigidity acts more remarkably than the linear expansion coefficient, and thus, the thermal deformation of the lower base plate 46 can be prevented.

On the other hand, the low rigidity support part has a configuration of reducing the rigidity in the direction of the extension or the contraction of the actuator plate 441 to be lower than that of the actuator plate 441. As such a configuration, in the present embodiment, there is adopted the adhesive (i.e., the soft adhesive) a32 for joining the lid part 432 of the flow channel member 43 to the sealing film f. Here, the soft adhesive a32 is not only lower in hardness than the hard adhesive a2, but also lower in hardness after curing than the adhesive a31 for joining the main body 431 of the flow channel member 43 to the sealing film f Thus, when input or output of heat to or from the inkjet head 4 occurs, it is possible to absorb a difference in an amount of deformation between the actuator plate 441 and the flow channel member 43 with the soft adhesive a31 to facilitate the natural thermal deformation of the actuator plate 441.

Figure 5B:
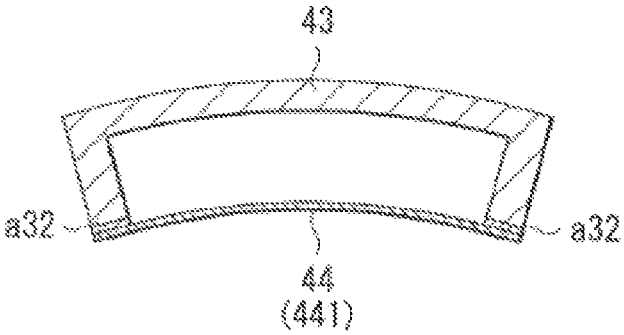

FIG. 5B schematically shows an action performed by the low rigidity support part related to the present embodiment when the input or output of the heat which causes the thermal deformation shown in FIG. 5A in the actuator plate 441. In the present embodiment, the soft adhesive a32 relatively low in hardness is adopted as the junction between the actuator plate 441 and the flow channel member 43 (specifically, the lid part 432 stronger in restraining effect) to be the restraining factor of the thermal deformation thereof to thereby make the low rigidity support part capable of following the thermal deformation of the actuator plate 441 to facilitate the natural thermal deformation of the actuator plate 441 with respect to the input or output of the heat.

The same applies to the input or output of the heat which causes the thermal deformation shown in FIG. 6A, and the soft adhesive a32 is adopted as the junction between the actuator plate 441 and the flow channel member 43 to thereby make the low rigidity support part capable of following the thermal deformation of the actuator plate 441.

Further, the hard adhesive a2 relatively high in hardness is adopted as the junction between the head chip joined body 4*a* and the lower base plate 46 to thereby make it possible to suppress the thermal deformation of the lower base plate 46 with respect to the input or output of the heat, and thus, the thermal deformation which causes the excessive concentration of the stress in the actuator plate 441 is prevented from occurring using the lower base plate 46 restricted in deformation as a support.

Operations

Operation of Printer 1

In the present embodiment, printing of images, characters, and so on to the recording paper M is performed by the printer 1. As an initial state, the four types of ink tanks 3 shown in FIG. 1 are sufficiently filled with the ink of the corresponding colors (the four colors), respectively. Further, the inkjet heads 4 are filled with the ink of the corresponding colors.

In the initial state, when operating the printer 1, the grit rollers 21 in the carrying mechanisms 2*a*, 2*b* rotate, and the recording paper M is held between the grit rollers 21 and the pinch rollers 22 to thereby be carried in the carrying direction d (the X direction). At the same time as such a carrying operation, the electric motor 341 in the drive mechanism 34 is driven to rotate the pulleys not shown to thereby move the carriage 33 via the endless belt 342. The carriage 33 reciprocates in the width direction of the recording paper M (the Y direction) while being guided by the guide rails 31, 32. By arbitrarily ejecting the ink from the inkjet heads 4 to the recording paper M while changing the relative positional relationship between the recording paper M and the carriage 33 in such a manner as described above, the printing of the images, the characters, and so on to the recording paper M is achieved.

Operation of Inkjet Head 4

In the inkjet head 4, the flow channels (the ink supply channels p1) of the ink proceeding from the introduction port 43*int* toward the discharge port 43*ext* are formed, and the ink is supplied to each of the jet holes 45*h* via the channels (the jet channels Ce1, Ce2) branched from the flow channels. Here, a part of the ink introduced into the flow channels via the introduction port 43*int* flows through the flow channels (the ink discharge channels p2) toward the discharge port 43*ext*, and another part thereof is introduced into the jet holes 45*h* when performing recording, and is jetted toward the recording paper M.

Functions and Advantages

The liquid jet heads (the inkjet heads 4) according to the present embodiment each have the configuration described hereinabove, and the advantages obtained by the present embodiment will hereinafter be described.

First, the low rigidity support part is disposed at one side (the side where the flow channel member 43 is disposed) of the actuator plate 441, the head chip 44 in the present embodiment, and at the same time, the high rigidity support part is disposed at the other side (the side where the lower base plate 46 is disposed), and then these support parts are bonded to the actuator plate 441. Thus, it becomes possible to achieve an adjustment of the rigidity balance of the structure for supporting the actuator plate 441 or the head chip joined body 4*a* including the actuator plate 441 to thereby suppress or reduce the stress generated in the actuator plate 441 due to the input or output of the heat to or from the inkjet head 4. Thus, it becomes possible to prevent the damage (e.g., the breakage of the actuator plate 441 when the actuator plate 441 is made of a ceramic material) due to the thermal deformation of the actuator plate 441 to thereby achieve securement or extension of the product life of the inkjet heads 4 and the printer 1.

Second, by adopting the hard adhesive a2 relatively high in hardness as the junction between the head chip joined body 4*a* and the lower base plate 46, and at the same time, adopting the soft adhesive a32 relatively low in hardness as the junction between the lid part 432 of the flow channel member 43 and the sealing film f, it becomes possible to easily provide a required rigidity to each of the high rigidity support part and the low rigidity support part. Further, according to the present embodiment, by selecting the types or the characteristics of the adhesives a2, a32, it becomes possible to easily achieve the adjustment of the rigidity balance without requiring addition of a new component.

Further, by adopting the adhesive a31 relatively high in hardness as the junction between the main body 431 of the flow channel member 43 and the sealing film f, it is possible to ensure the liquid-tightness of the flow channels (the ink introduction channels p1, the ink discharge channels p2) while achieving the adjustment of the rigidity balance by the selection of other adhesives (the had adhesive a2, the soft adhesive a32).

DESCRIPTION OF MODIFIED EXAMPLES

First Modified Example

In the example described above, in order to provide the low rigidity support part with the lower rigidity than that of the actuator plate 441, an element different from the flow channel member 43 itself is adopted, and the lid part 432 of the flow channel member 43 and the sealing film f are joined to each other with the soft adhesive a32 relatively low in hardness. The decrease in rigidity to be provided to the low rigidity support part is achieved not only by the above, but also by reducing the rigidity of the flow channel member 43 included in the low rigidity support part.

Figure 7:
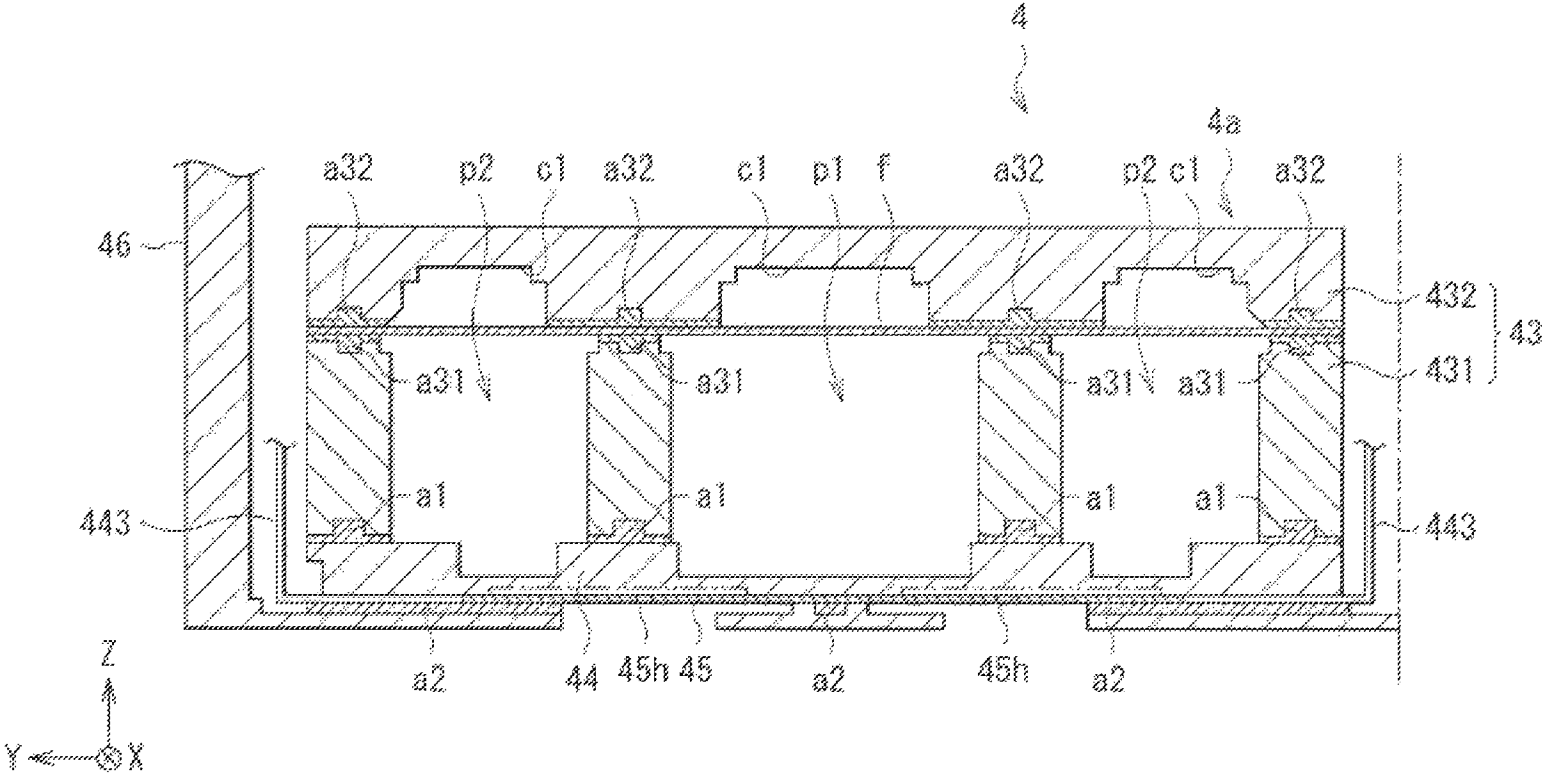
FIG. 7 is a cross-sectional view similar to FIG. 4 and showing a configuration of a modified example of the inkjet head according to the embodiment.

FIG. 7 is a cross-sectional view similar to FIG. 4 and showing a configuration of a modified example of the inkjet head 4 according to the present embodiment.

The rigidity of the flow channel member 13 can be reduced by the selection of the material constituting the flow channel member 43, and can also be reduced by the adjustment of the shape of the flow channel member 43. As an example of the latter, for example, a thin wall part formed to be thinner in wall thickness than the other part is provided to a part of the flow channel member 43, specifically a structure element to be an impediment on the deformation of the flow channel member 43 following the thermal deformation of the actuator plate 441, to provide the elastic property to the structure element to be the impediment. In the present embodiment, an upper thin wall part c1 is provided to the structure element extending in a direction parallel to the direction of the extension or the contraction due to the thermal deformation of the actuator plate 441. Thus, the rigidity of the flow channel member 43 is reduced through the reduction in wall thickness of the flow channel member 43 (specifically the lid part 432) to thereby make it possible to follow the thermal deformation of the actuator plate 441.

In this modified example, the upper thin wall part c1 constitutes a "low rigidity part" related to the present embodiment.

Second Modified Example

Figure 8:
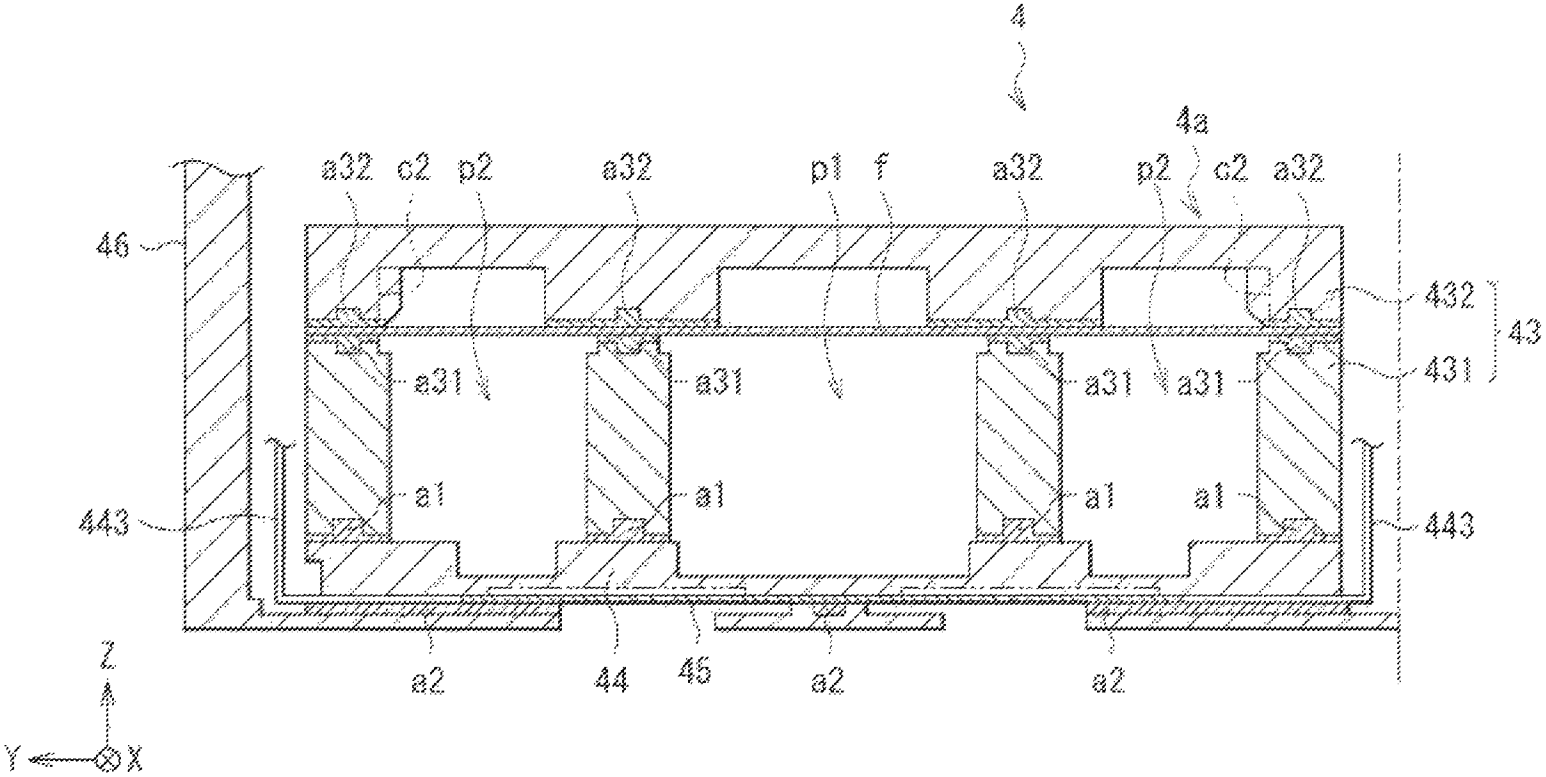
FIG. 8 is a cross-sectional view similar to FIG. 4 and showing a configuration of another modified example of the inkjet head according to the embodiment.

FIG. 8 is a cross-sectional view similar to FIG. 4 and showing another modified example of the inkjet head 4 according to the present embodiment.

In the example shown in FIG. 8, similarly to the example shown in FIG. 7, a thin \wall part (hereinafter referred to as a "lateral thin wall part") c2 formed to be thinner in wall thickness than the other part is provided to a part of the flow channel member 43, specifically a structure element extending in a direction perpendicular to the direction of the extension or the contraction due to the thermal deformation of the actuator plate 441, to provide the flow channel member 43 with a shape flexible in the direction of the thermal deformation caused in the actuator plate 441. Thus, the rigidity of the flow channel member 43 is reduced so as to be able to follow the thermal deformation of the actuator plate 441.

In this modified example, the lateral thin wall part c2 constitutes the "low rigidity part" related to the present embodiment.

In the above description, as the head constituent member higher in both of linear expansion coefficient and Young's modulus than the actuator plate 441, there is adopted the lower base plate 46 having stainless steel as the constituent material. Further, as described above, in the present embodiment, since not only the lower base plate 46 but also the nozzle plate 45 have stainless steel as the constituent material to be higher in linear expansion coefficient and Young's modulus than the actuator plate 441, it is possible to assume that the nozzle plate 45 also corresponds to the head constituent member of the high rigidity support part in addition to the lower base plate 46. In other words, it is possible to use the nozzle plate 45 and the lower base plate 46 as the support for preventing the thermal deformation of the actuator plate 441 by fixing the nozzle plate 45 and the lower base plate 46 to each other with the hard adhesive, or stacking them and then joining them to another high rigidity part.

Further, besides the above, it is also possible to make either one of the nozzle plate 45 and the lower base plate 46 be formed of a material lower in Young's modulus, and make the other alone function as the head constituent member. As an example of this case, the lower base plate 46 is formed from stainless steel, while the nozzle plate 45 is formed from a material (e.g., polyimide) lower in Young's modulus than stainless steel.

Some of the concepts which can be derived from the above description will be recited below.

<1> A liquid jet head comprising: an actuator member having a pressure chamber; a low rigidity support part which is disposed at one side with respect to the actuator member, and is coupled to the actuator member; and a high rigidity support part which is disposed at the other side opposite to the one side with respect to the actuator member, and is coupled to the actuator member, wherein the high rigidity support part has a high rigidity part which includes a head constituent member of the liquid jet head higher in linear expansion coefficient and Young's modulus than the actuator member, and which reduces a thermal deformation of the high rigidity support part in a direction of extension or contraction of the actuator member with respect to input or output of heat to or from the liquid jet head to be smaller than a thermal deformation exhibited in the direction of the extension or the contraction by the head constituent member with respect to the input or the output of the heat, and the low rigidity support part is lower in rigidity in the direction of the extension or the contraction than the actuator member.

<2> The liquid jet head according to <1>, further comprising a flow channel member which is disposed at the one side of the actuator member, and which is provided with a flow channel of liquid to be supplied to the pressure chamber, wherein the low rigidity support part includes the flow channel member.

<3> The liquid jet head according to <2>, wherein the flow channel member is formed of a material higher in linear expansion coefficient and lower in Young's modulus than the actuator member.

<4> The liquid jet head according to <2> or <3>, wherein the flow channel member has a low rigidity part which facilitates a deformation of the flow channel member following a deformation of the actuator member.

<5> The liquid jet head according to any one of <1> to <4>, further comprising a nozzle member which is disposed at the other side of the actuator member, and which is provided with a jet hole communicated with the pressure chamber and opening toward an outside, wherein the high rigidity support part includes the nozzle member as the head constituent member.

<6> The liquid jet head according to any one of <1> to <5>, further comprising a base member which is disposed at the other side of the actuator member, and which is provided with a support surface to which the actuator member is joined, wherein the high rigidity support part includes the base member as the head constituent member.

<7> The liquid jet head according to <6>, further comprising a flow channel member disposed at the one side of the actuator member, wherein the flow channel member includes a main body provided with a flow channel of liquid to be supplied to the pressure chamber, and a lid part joined to the main body via a sealing film having liquid impermeability, the base member is bonded to the actuator member with a first adhesive, the lid part is bonded to the sealing film with a second adhesive, and the first adhesive is higher in hardness after curing than the second adhesive.

<8> The liquid jet head according to <7>, wherein the main body is bonded to the sealing film with a third adhesive, and the third adhesive is higher in hardness after curing than the second adhesive.

<9> The liquid jet head according to <7> or <8>, wherein the lid part has elasticity in a direction of the deformation of the actuator member due to the input or the output of heat.

<10> A liquid jet recording device comprising: the liquid jet head according to any one of <1> to <9>; a carriage to which the liquid jet head is attached; and a support mechanism configured to support the carriage at a predetermined relative position to a recording target medium.

What is claimed is:

1. A liquid jet head comprising:

an actuator member having a pressure chamber;

a low rigidity support part which is disposed at one side with respect to the actuator member, and is coupled to the actuator member; and a high rigidity support part which is disposed at the other side opposite to the one side with respect to the actuator member, and is coupled to the actuator member, wherein the high rigidity support part has a high rigidity part which includes a head constituent member of the liquid jet head higher in linear expansion coefficient and Young's modulus than the actuator member, and which reduces a thermal deformation of the high rigidity support part in a direction of extension or contraction of the actuator member with respect to input or output of heat to or from the liquid jet head to be smaller than a thermal deformation exhibited in the direction of the extension or the contraction by the head constituent member with respect to the input or the output of the heat, and the low rigidity support part is lower in rigidity in the direction of the extension or the contraction than the actuator member, wherein the liquid jet head further comprises a flow channel member which is disposed at the one side of the actuator member, and which is provided with a flow channel of liquid to be supplied to the pressure chamber, wherein the low rigidity support part includes the flow channel member, and wherein the flow channel member is formed of a material higher in linear expansion coefficient and lower in Young's modulus than the actuator member.

2. The liquid jet head according to claim 1, wherein the flow channel member has a low rigidity part which facilitates a deformation of the flow channel member following a deformation of the actuator member.

3. The liquid jet head according to claim 1, further comprising a nozzle member which is disposed at the other side of the actuator member, and which is provided with a jet hole communicated with the pressure chamber and opening toward an outside, wherein the high rigidity support part includes the nozzle member as the head constituent member.

4. The liquid jet head according to claim 1, further comprising a base member which is disposed at the other side of the actuator member, and which is provided with a support surface to which the actuator member is joined, wherein the high rigidity support part includes the base member as the head constituent member.

5. The liquid jet head according to claim 4, further comprising a flow channel member disposed at the one side of the actuator member, wherein the flow channel member includes:

a main body provided with a flow channel of liquid to be supplied to the pressure chamber, and a lid part joined to the main body via a sealing film having liquid impermeability, the base member is bonded to the actuator member with a first adhesive, the lid part is bonded to the sealing film with a second adhesive, and the first adhesive is higher in hardness after curing than the second adhesive.

6. The liquid jet head according to claim 5, wherein the main body is bonded to the sealing film with a third adhesive, and the third adhesive is higher in hardness after curing than the second adhesive.

7. The liquid jet head according to claim 5, wherein the lid part has elasticity in a direction of the deformation of the actuator member due to the input or the output of heat.

8. A liquid jet recording device comprising:

the liquid jet head according to claim 1;

a carriage to which the liquid jet head is attached; and a support mechanism configured to support the carriage at a predetermined relative position to a recording target medium.

* * * * *